United States Patent [19]

Hall et al.

[11] 4,323,645

[45] Apr. 6, 1982

[54] ORGANIC HALOGEN COMPOUNDS FOR NEGATIVE-WORKING SILVER HALIDE EMULSIONS

[75] Inventors: Laurence W. Hall, Asheville, N.C.; Joseph D. Overman, Wilmington, Del.

[73] Assignee: E. I. Du Pont de Nemours and Company, Wilmington, Del.

[21] Appl. No.: 174,551

[22] Filed: Aug. 1, 1980

[51] Int. Cl.[3] ..... G03C 1/02

[52] U.S. Cl. ..... 430/564; 430/569; 430/599; 430/607; 430/613; 430/966

[58] Field of Search ..... 430/569, 607, 613, 966, 430/564, 599, 600, 606, 621, 631, 566

[56] References Cited

U.S. PATENT DOCUMENTS

| | | | |
|---|---|---|---|
| 2,418,629 | 4/1947 | Fallesen | 430/569 |
| 3,146,104 | 8/1964 | Yackel et al. | 430/566 |
| 3,420,667 | 1/1969 | Copeland | 430/599 |
| 3,523,795 | 8/1970 | Ohkubo et al. | 430/566 |
| 3,632,340 | 1/1972 | Illingsworth | 96/64 |
| 4,132,551 | 1/1979 | Pollet et al. | 430/607 |

FOREIGN PATENT DOCUMENTS

| | | | |
|---|---|---|---|
| 2332754 | 1/1974 | Fed. Rep. of Germany | 430/600 |
| 50-919049 | of 1975 | Japan . | |

*Primary Examiner*—Mary F. Downey

[57] ABSTRACT

Small amounts of specific organic halogen compounds added to medical X-ray emulsions (ex. 2-chloro-4-nitrobenzyl chloride, 2,2,2-trichloroethanol and m-nitrobenzyl chloride) give significantly reduced fog levels accompanied by little or no speed loss.

6 Claims, No Drawings

ORGANIC HALOGEN COMPOUNDS FOR NEGATIVE-WORKING SILVER HALIDE EMULSIONS

TECHNICAL FIELD

This invention is in the field of photography, and more particularly relates to negative-working silver halide emulsions characterized by reduced fog and improved aging stability.

BACKGROUND OF THE INVENTION

A wide variety of organic and inorganic compounds are used for the complex series of steps by which a negative-working silver halide emulsion of high sensitivity is produced. One such step involves the chemical sensitization of the silver halide grains to increase their light sensitivity. Between the time of adding the sensitizer and coating the liquid emulsion, the latter is usually given a heat treatment, called digestion. During digestion a reaction is believed to occur which produces sensitivity sites on the surface of the silver halide grains. Unfortunately, as the digestion reaction is continued in order to obtain a higher level of sensitivity, some silver halide grains become spontaneously developable without exposure. This causes the emulsion to fog. Films made with grains which have undergone digestion to achieve high sensitivity not only exhibit this fog when tested shortly after being coated, but display higher levels of fog as the film is aged. This may reach a level such that the film is unusable and in any case limits the useful life of the film. Undesirable losses in sensitivity may also accompany the increase in fog as the film ages.

Efforts to obtain higher sensitivity for negative-working silver halide emulsions must in some fashion deal with the problem. One practical method of doing this is to tolerate some acceptable fog level in commercial photographic emulsions. Another is to add antifoggant or stabilizer compounds to reduce fresh fog and/or to prevent the formation of aging fog while accepting some sacrifice of sensitivity as a tradeoff for the improvement.

SUMMARY OF THE INVENTION

The present invention attacks the fog problem encountered in negative-working silver halide emulsions by providing a group of organic halogen compounds which are selectively effective in eliminating fresh fog from highly sensitized emulsions and preventing formation of fog on aging.

In accordance with this invention, a negative-working silver halide emulsion of lower fog and superior aging stability is produced by the incorporation therein of one or more organic halogen compounds selected from the following: 2,2,2-trichloroethanol, m-nitrobenzyl chloride, 3-chloroaniline, 2-chloro-4-nitrobenzyl chloride, o-chloranil, p-nitrobenzyl chloride, chlorohydroquinone, 4-chloro-2-nitrobenzyl chloride, 4-chloro-3-nitrobenzyl chloride, o-nitrobenzyl chloride, $\alpha,\alpha,\alpha$-trichlorotoluene, 4,6-dichloro-5-nitropyrimidine, 5-chloro-2(trichloromethyl) benzimidazole, 2-chloro-3 nitropyridine, and 2-amino-3,5-dichloropyridine.

These compounds lower the fresh and aging fog without adversely affecting speed, gradation, and top density of the coated films. For example small amount of 2-chloro-4-nitrobenzyl chloride, 2,2,2-trichloroethanol, and m-nitrobenzyl chloride reduce the fog of medical X-ray emulsion with little or no speed loss and also improve aging stability. This new technology offers an opportunity to develop products with superior diagnostic clarity, use alternate sensitization techniques which would otherwise give high fog, or trade off all or part of these advantages for lower silver coating weight.

DETAILED DESCRIPTION OF THE INVENTION

The foregoing organic halogen compounds are effective when added to the emulsion in amounts of from 1 to 1000 mg/mole of silver halide at the completion of the chemical sensitization, or even when added immediately prior to coating as e.g. by in-line injection. In some cases it is desirable to hold the emulsion containing the organic halogen compound at an elevated temperature for a period sufficient to allow a reaction to occur which lowers the fog to the desired level. Some of these compounds are believed to be such potent oxidants that they need only a very short holding time in the liquid emulsion, thereby lowering fog initially and on aging.

In general, the organic halogen compounds useful for the present invention may be characterized as oxidizing agents which appear to selectively react with the fog sites on the silver halide grains. Some of those compounds, e.g., 2-chloro-4-nitrobenzyl chloride and o-chloranil, are sufficiently reactive that it is possible to obtain the benefits of the present invention by simply mixing the compound with the emulsion just prior to coating, as by the in-line injection process disclosed in Abele et al, U.S. Pat. No. 4,124,397.

Other compounds such as 3-chloroaniline and o-nitrobenzyl chloride are less effective when in-line injection is attempted. The most beneficial results are obtained when (1) they are added to an emulsion which contains all the additions normally added to completed emulsions prior to coating, (2) followed by a digestion holding period at 35° C. for 15 minutes to 3 hours to allow the oxidation-reduction process to proceed. Higher temperatures accelerate the action of these organic halogen compounds. However, this can become counterproductive because elevated temperatures tend to cause increased fog in highly sensitized emulsions.

The present invention is operative with silver halide grains produced by single jet, splash, and double jet precipitation techniques, to yield heterodisperse and monodisperse grain size distributions. Into the grains made by such known techniques metal ions may be introduced to modify the photographic response, and nonmetallic compounds may be added to increase sensitivity or restrain fog. In some cases it may be desirable to wash grains which have been chemically modified, and to then further increase the size of the grains by precipitating a layer of silver halide over the original grains. The term "core-shell" grain has come to apply to such layered grains.

The silver halide constituent of the negative-working silver halide emulsions described herein may consist of pure or mixed silver chloride, bromide, or iodide, and the grains may be regular or irregular in shape, e.g., cubic, octahedral, rhombohedral, etc.

As a binder agent and peptizing media for these emulsions it is normal to employ gelatin. However, gelatin may be partially or wholly replaced by other natural or synthetic protective colloids known in the art.

Other useful additives include ortho- and panchromatic sensitizing dyes; speed-increasing compounds such as polyalkylene glycols; surface active agents which are useful as coating aids; antifoggants; and stabilizers, including indazoles, imidazoles, azaindenes, heavy metal compounds such as mercury salts, and polyhydroxy benzene compounds.

Other useful ingredients for these negative-working elements include hardeners, antistatic agents, matting agents, plasticizers, brighteners, and natural and synthetic wetting agents. All these ingredients may be combined to yield formulations capable of being coated on suitable supports such as cellulose nitrate film, cellulose ester film, poly(vinyl acetal) film, polystryrene film, poly(ethylene terephthalate) film, and related films, as well as glass, paper, metal and the like.

The invention is illustrated by the following Examples.

EXAMPLE 1

A high speed negative iodobromide emulsion was prepared using gold-sulfur sensitization as well known in the art. 4-hydroxy-6-methyl-1,3,3a,7 tetraazaindene and 1-phenyl-5-mercaptotetrazole were added after the completion of the digestion reaction to stabilize the sensitometric properties of the emulsion. The emulsion was fed by positive displacement gear pumps to a two-slot coating bar where it was applied to a poly(ethylene terephthalate) support and simultaneously wet-overcoated with a protective gelatin overcoat. The two-layer coating was chilled and then dried to produce a photographic film which served as a control.

The setup used for delivering emulsion to the bar contained a provision for in-line injection as described in Abele et al, U.S. Pat. No. 4,124,397. This was used to inject three of the compounds of the present invention. One experimental film contained 133 mg of 2,2,2-trichloroethanol (TCE) per mole of silver halide. Another contained 67 mg of m-nitro benzyl chloride (MNC) per mole of silver halide. Another contained 33 mg of 2-chloro-4-nitrobenzyl chloride (CNC) per mole of silver halide. The coated film samples were held for four days after coating prior to being machine developed. One set of film samples was then exposed in a CRONEX sensitometer and machine developed at 33° C. for 19 sec. in CRONEX XMD continuous tone developer. Another set of film samples was developed at 39° C. for 19 sec. to measure overdevelopment fog (OD fog). Both sets were fixed and washed. Results of these tests are summarized in the following table.

TABLE 1

| Compound Added | | 4 day test | 1 mo. test | 3 mo. test |
|---|---|---|---|---|
| None (control) | Rel. Speed | 100 | 100 | 100 |
| | Fog | .06 | .06 | .07 |
| | OD Fog | .09 | .07 | .15 |
| TCE | REl. Speed | 103 | 96 | 95 |
| | Fog | .03 | .03 | .05 |
| | OD Fog | .07 | .04 | .10 |
| MNC | REl. Speed | 98 | 92 | 105 |
| | Fog | .03 | .03 | .06 |
| | OD Fog | .07 | .04 | .18 |
| CNC | Rel. Speed | 98 | 95 | 100 |
| | Fog | .05 | .04 | .05 |
| | OD Fog | .07 | .05 | .12 |

The data from Table 1 illustrates that the experimental films containing organic halogen compounds of the present invention not only have lowered fog but have maintained this advantage as the films age. At 3 mo. age all films display relative speeds within a 5% range corresponding to the test error. In two out of three of the experiments on aging the increase in fog caused by overdevelopment (OD fog) is also improved.

The top density and gradient of the experimental films remained equivalent to the control, further illustrating that the fog improvement does not degrade the sensitometric properties of the emulsion.

EXAMPLE 2

Emulsion was prepared as in Example 1 except that it was divided into splits from which individual coatings were made with and without additions of the organic halogen compounds of the present invention. In the cases of addition the experimental emulsions were held for 15 min. at 35° C. after such addition, to permit the fog reduction reaction to take place. Film samples were exposed and developed as in Example 1. Results are given in the following table.

TABLE 2

| Compound Added | Amount: Mg/mol AgX | Relative Speed | Fog |
|---|---|---|---|
| None (control) | — | 100 | .09 |
| 3-chloroaniline | 333 | 91 | .07 |
| 3-chloroaniline | 666 | 103 | .06 |
| m-nitrobenzyl chloride | 133 | 97 | .05 |
| m-nitrobenzyl chloride | 267 | 103 | .04 |

These results illustrate that the amount of the organic halogen compound which is effective may vary over a wide range. From 33 to 133 mg gave significant fog reduction with in-line injected compounds. Generally higher amounts were required in the case of those compounds which are best utilized when premixed with the liquid emulsion.

EXAMPLE 3

A comparison was made of the relative effects of 2-chloro-4-nitrobenzyl chloride (CNC), both in-line injected and held in the emulsion for 3 hours at 35° C. prior to coating. Table 3 contains the results.

TABLE 3

| Coating | Amount: Mg/mol AgX | Relative Speed | Fog |
|---|---|---|---|
| Control | — | 100 | .05 |
| 3 hr. hold | 17 | 98 | .04 |
| 3 hr. hold | 33 | 88 | .02 |
| 3 hr. hold | 67 | 79 | .02 |
| In-line injection | 23 | 103 | .04 |
| In-Line injection | 33 | 105 | .03 |

It is evident that in-line injection of CNC avoids the speed loss which occurs when this compound is held in the liquid emulsion.

EXAMPLE 4

A high speed emulsion was prepared as in Example 1 except that 1-phenyl-5-mercaptotetrazole was omitted as a final addition. A portion of this emulsion was coated and overcoated as in Example 2 and served as a control. Two portions of this emulsion received additions of o-nitrobenzyl chloride which were held and mixed for at least 15 minutes at 35° C. prior to coating. Test results of films containing these emulsions are contained in Table 4.

TABLE 4

| Amount Added: mg/mole AgX | Relative Speed | Fog |
|---|---|---|
| None (control) | 100 | .09 |
| 50 | 106 | .06 |
| 100 | 87 | .03 |

This illustrates that the organic halogen compound functions even in the absence of a potent antifoggant such as 1-phenyl-5-mercaptotetrazole.

EXAMPLE 5

Tests were run similar to Example 2 except that the emulsion also contained an ortho sensitizing dye to give green sensitivity to films containing this emulsion. A portion of emulsion received no further additions and served as a control, while other portions contained compounds of the present invention mixed in the liquid emulsion for at least 15 minutes at 35° C. prior to coating. Results are shown in Table 5.

TABLE 5

| Compound Added | Amount Added mg/mole AgX | Relative Speed | Fog |
|---|---|---|---|
| None | — | 100 | .11 |
| 2,2,2-trichloro-ethanol | 200 | 103 | .08 |
| 3-Chloroaniline | 400 | 96 | .08 |

This illustrates the application of the present invention to dye-sensitized emulsions as well as nonspectrally-sensitized negative-working emulsions.

We claim:

1. A negative-working silver halide emulsion having low fog and improved aging stability, characterized in that the preparation of said emulsion includes an after-digestion of, or in-line injection of, an organic halogen compound selected from the group consisting of 2,2,2-trichloroethanol, m-nitrobenzyl chloride, 3-chloroaniline, 2-chloro-4-nitrobenzyl chloride, o-chloranil, p-nitrobenzyl chloride, 4-chloro-2-nitrobenzyl chloride, 4-chloro-3-nitrobenzyl chloride, o-nitrobenzyl chloride, α,α,α,-trichlorotoluene, 4,6-dichloro-5-nitropyrimidine, 5-chloro-2(trichloromethyl)benzimidazole, 2-chloro-3-nitropyridine and 2-amino-3,5-dichloropyridine.

2. The emulsion of claim 1 wherein said organic halogen compound is present in a concentration of 1–1000 mg/mole of silver halide.

3. The emulsion of claim 1 wherein the silver halide is AgIBr.

4. A medical X-ray film comprising a polyester film support coated with the negative-working silver halide emulsion of claim 1.

5. A process for the production of a medical X-ray film containing a negative-working silver halide emulsion which consists essentially of the steps of:

(1) preparing a silver halide precipitate in a colloid binder;

(2) sensitizing the resultant emulsion;

(3) adding to the sensitized emulsion by in-line injection an organic halogen compound selected from the group consisting of 2,2,2-trichloroethanol, m-nitrobenzyl chloride, 3-chloroaniline, 2-chloro-4-nitrobenzyl chloride, o-chloranil, p-nitrobenzyl chloride, 4-chloro-2-nitrobenzyl chloride, 4-chloro-3-nitrobenzyl chloride, o-nitrobenzyl chloride, α,α, α,-trichlorotoluene, 4,6-dichloro-5-2(trichloromethyl)benzimidazole, 2-chloro-3-nitropyridine and 2-amino-3,5-dichloropyridine; and (4) coating the emulsion upon a support.

6. A process for the production of a medical X-ray film containing a negative-working silver halide emulsion which consists essentially of the steps of:

(1) preparing a silver halide precipitate in a colloid binder;

(2) sensitizing the resultant emulsion;

(3) adding to the sensitized emulsion an organic halogen compound selected from the group consisting of 2,2,2,-trichloroethanol, m-nitrobenzyl chloride, 3-chloroaniline, 2-chloro-4-nitrobenzyl chloride, o-chloranil, p-nitrobenzyl chloride, 4-chloro-2-nitrobenzyl chloride, 4-chloro-3-nitrobenzyl chloride, o-nitrobenzyl chloride, α,α,α,-trichlorotoluene, 4,6-dichloro-5-nitropyrimidine, 5-chloro-2(trichloromethyl)benzimidazole, 2-chloro-3-nitropyridine and 2-amino-3,5-dichloropyridine, followed by a digestion step; and (4) coating the emulsion upon a support.

* * * * *